US005682932A

United States Patent [19]

Ediger

[11] Patent Number: 5,682,932

[45] Date of Patent: Nov. 4, 1997

[54] HUMIDIFIER WATER BOTTLE

[75] Inventor: Glen W. Ediger, North Newton, Kans.

[73] Assignee: Vornado Air Circulation Systems, Inc., Wichita, Kans.

[21] Appl. No.: 373,398

[22] Filed: Jan. 17, 1995

[51] Int. Cl.[6] ..... B65D 25/00

[52] U.S. Cl. ..... 141/366; 141/284; 141/286; 141/324; 222/190; 222/325; 222/564; 261/72.1; 220/631; 220/661; 220/478; 220/771

[58] Field of Search ..... 141/319, 320, 141/324, 284, 286, 364–366, 375, 383, 386, 392; 220/374, 476, 478, 480, 601, 631, 661, 756, 771; 222/325, 190, 564, 566, 571, 572; D23/356, 358; 261/72.1, 104, 107; 312/31.2, 31.3

[56] References Cited

U.S. PATENT DOCUMENTS

| | | | |
|---|---|---|---|
| D. 189,393 | 12/1960 | Schlumbohm | D23/356 |
| 299,010 | 5/1884 | Record | 141/366 |
| 364,316 | 6/1887 | Stacy | 222/564 |
| 911,262 | 2/1909 | Perry | 220/631 |
| 983,725 | 2/1911 | Keilly | 222/564 |
| 1,381,546 | 6/1921 | Dziambor | 222/564 |
| 1,456,408 | 5/1923 | Scherer | 141/366 |
| 2,239,092 | 4/1941 | Gammill | 222/571 |
| 2,717,094 | 9/1955 | Moore | 220/661 |
| 3,476,297 | 11/1969 | Swett et al. | 222/564 X |
| 3,641,912 | 2/1972 | Mills et al. | 220/771 X |
| 4,640,855 | 2/1987 | St. Clair | 222/572 |
| 4,848,602 | 7/1989 | Yoshimura et al. | 222/564 |
| 4,928,860 | 5/1990 | Knight | 220/631 |
| 5,480,588 | 1/1996 | Tomasiak et al. | 261/72.1 |
| 5,482,190 | 1/1996 | Stanek et al. | 261/72.1 X |

*Primary Examiner*—J. Casimer Jacyna
*Attorney, Agent, or Firm*—Edward L. Brown, Jr.

[57] ABSTRACT

A humidifier water bottle having an opening therein with a funnel shape to assist filling, the same opening also performs a valving function as to the water in the bottle which blocks the flow of water as the bottle is rotated from a horizontal position to a near vertical position whereupon the geometry of the opening allows the water to flow into the reservoir of the humidifier and maintain a constant level.

7 Claims, 3 Drawing Sheets

HUMIDIFIER WATER BOTTLE

BACKGROUND OF THE INVENTION

This invention relates to humidifiers and more specifically to the water storage bottle of an evaporative type home humidifier.

Conventional small capacity home humidifiers of the evaporative type include a reservoir or tank of water through which an endless polyurethane foam belt passes. Air is blown through the foam belt as it moves by the blower and the passing air evaporates water from the belt into the air.

Another more simplified humidifier on the market includes a stationary wicking element, in place of the rotating foam belt, with its lower edge immersed in the water so that the water moves up by capillary action through the wick material while a fan blows air across the wick to evaporate the water. In order to permit the wicking element to maintain a constant depth of immersion, the depth of the water in the trough must be maintained constant even though the water bottles supplying the trough will have varying heights as the humidifier runs. These types of wicking humidifiers include a storage or reservoir bottle which supplies water to the trough at a constant level. The bottles include a very simple valving mechanism wherein the fill opening of the bottle extends down into the trough, with the bottom edge of the opening maintaining the constant level of the water in the trough. As the water level in the trough drops below the edge of the fill opening, water will flow from the bottle into the trough until the bottom edge of the fill opening is again covered.

The general construction of these bottles is well known in the humidifier art and includes a valving opening in the bottom of the bottle. To place a full bottle into the humidifier, it must be inverted with an obvious spillage problem upon inversion. The typical solution to this problem is accomplished with the usage of a spring-biased poppet valve located in the opening of the bottle which is opened by an extending pin which comes in contact with the bottom trough of the humidifier as the bottle is placed into the humidifier. U.S. Pat. No. 4,663,091 to Seo and U.S. Pat. No. 5,162,088 to Peng illustrate these types of commonly used valves. Frequently these valving openings also function as the fill hole for the bottle and the plunger actuated valve is located in a screw-on cover cap for the fill opening, as shown in the above mentioned patent to Peng.

SUMMARY OF THE INVENTION

The water bottle design of the present invention is a very simplified design without the use of a valve in the bottle fill hole. The fill hole also functions as a valving opening when the bottle is inverted and placed in the humidifier. The fill hole is formed in the molded bottle with a funnel shape so that it can be readily filled from a water spigot without any concern for spillage. After the bottle is filled, it is transported in a horizontal position to the humidifier where a lateral groove across the bottom edge of the bottle engages the outer edge of the humidifier housing as a pivot point when the bottle is rotated upward into a vertical position in the humidifier housing. In this vertical operating position, the water freely flows into the trough until it reaches the rearward edge of the fill opening. By reason of the geometry of the valving opening, water will not flow out of the opening until the bottle reaches a near vertical position which by then the valve opening of the bottle is completely within the water trough of the humidifier. As long as the forward edge of the fill opening remains above the rearward edge, the standing water in the bottle will not flow.

The handle is integrally formed with the bottle at a position slightly offset from the center of gravity of a filled bottle so that as the bottle is lifted from its horizontal filling position, it tends to tip upward to elevate the fill hole and prevent spillage. Once the bottle is placed within the humidifier and rotated to its full vertical operating position, the support point of the humidifier housing is outside the center of gravity of the bottle so that the weight of the bottle holds the bottle against the housing wall of the humidifier and no latching means is required.

The tapered shape of the fill funnel self-aligns the bottle with the humidifier housing as it is rotated toward its vertical position.

Other features and advantages of the invention will become apparent to those skilled in the art upon review of the following detailed description, claims and drawings.

DESCRIPTION OF THE PREFERRED EMBODIMENT

Figure 1:
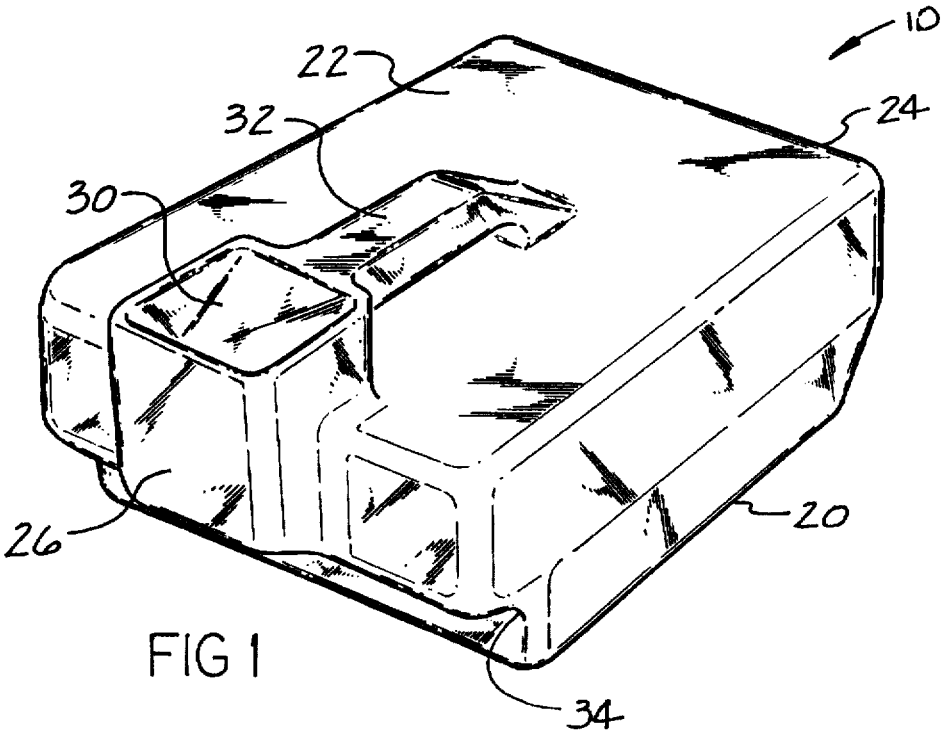
FIG. 1 is a perspective view of the HUMIDIFIER WATER BOTTLE in its horizontal filling position.

The humidifier fill bottle of the present invention is generally described by reference numeral 10 and is shown in a perspective view in FIG. 1. The humidifier into which the bottle is positioned is generally described by reference numeral 14 is only partially illustrated in FIGS. 4, 5 and 6. The humidifier 14 actually includes an identical second bottle on the left side of the humidifier which is not shown in the drawings. The interior workings of the humidifier are common in all wick type conventional home humidifiers and are not considered a part of the present invention. Those various working elements, which are not shown in the drawing, would be located in interior space 16 and would include a fan and a stationary wick, the bottom edge of which would be positioned in water trough 18 so that the wick would always remain wet due to the capillary action of the water.

Figure 6:
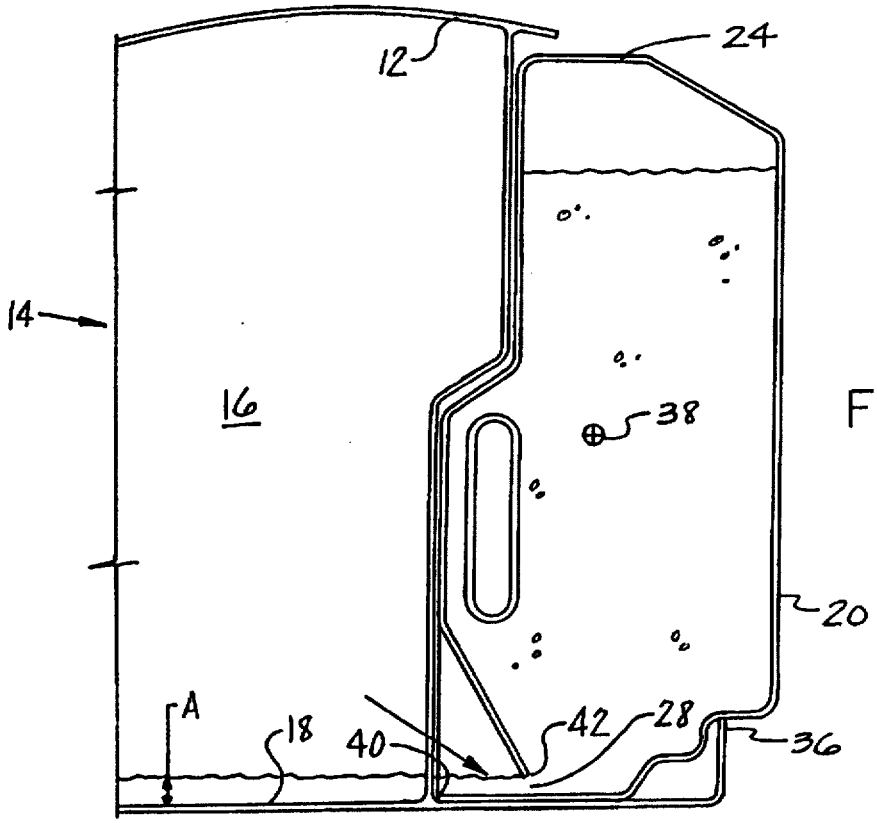
FIG. 6 is a similar sectional view to FIG. 2 with the bottle in its operating position.

In FIG. 6, portions of the humidifier housing 12 are shown, including a water trough 18 located in the bottom of the humidifier housing 12. A water level A is maintained in the trough 18 when the bottle 10 is in place. The humidifier housing includes an outer edge of the housing 36 at the right end of the trough 18. The water bottle 10 can be formed of various plastic materials which can be molded by various techniques including blow molding.

The bottle 10, as shown in FIG. 1, is in a horizontal position; however, its walls will be described hereafter as if it was vertically positioned, as seen in FIG. 6.

Figure 2:
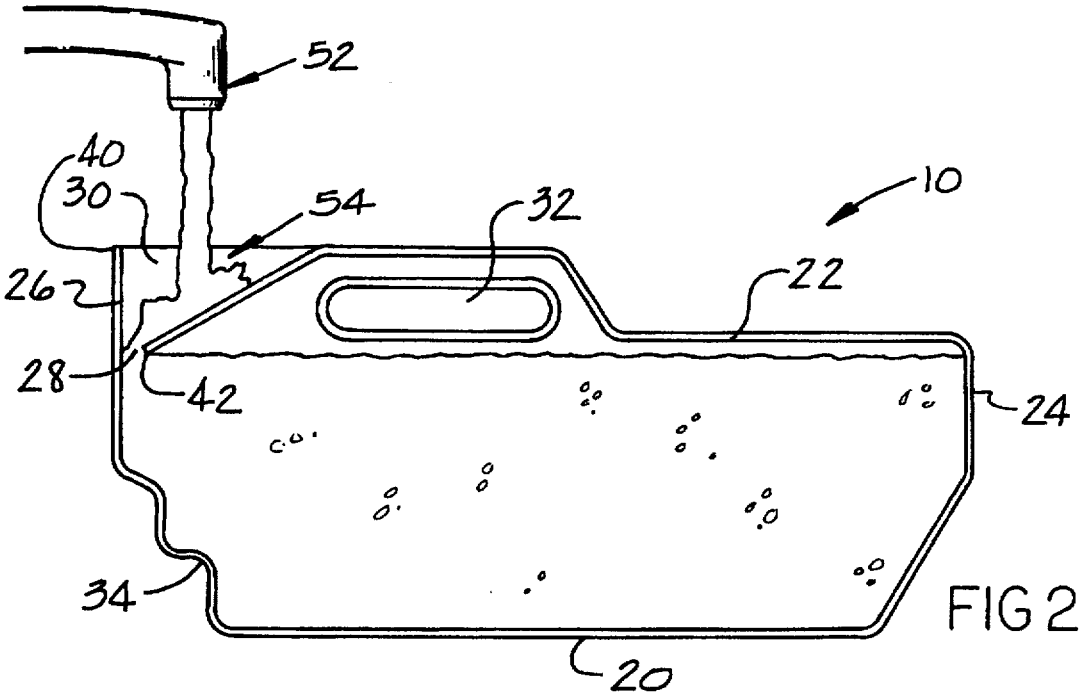
FIG. 2 is a vertical longitudinal sectional view of the bottle in the filling position.

Bottle 10 includes a first planar side 20, a second side 22, a top 24 and a bottom 26. At the juncture of side 22 and bottom 26 is a fill opening 28, as best seen in FIG. 2. Fill opening 28 includes a forward edge 40 and a rearward edge 42. Positioned immediately above fill opening 28 is a portion of the bottle wall shaped as a funnel 30 for assistance in filling the bottle. Contiguous with funnel 30 is a handle 32, as best seen in FIGS. 1 and 2. The exterior surface of bottle 10 surrounding the funnel 30 is tapered inward in shape from the bottle toward the entry face of funnel 30. There is a mating opening, not shown in the drawing, in the humidifier housing 12 for receipt of this extending portion of the bottle which encompasses the funnel 30.

Located along the bottom edge of the bottle 10, adjacent its intersection with side 20, is a lateral groove 34 extending thereacross, as seen in all the figures. This groove functions as a pivot point on the outer edge 36 of the humidifier housing as the bottle is rotated to its vertical operative position, as shown in FIG. 6.

The humidifier 14 actually includes a second identical bottle 10, not shown in the drawing, which is positioned on the left side of the humidifier 14, as seen in FIG. 6, wherein the inner workings, not shown in the drawings, are sandwiched there between the two bottles which both supply a common water trough 18 in the bottom of the humidifier housing.

OPERATION

An empty bottle 10 is positioned under a spigot 52, as shown in FIG. 2. The water upon entering funnel 30 flows in a direction indicated arrow 54 through fill opening 28 to fill the bottle. Opening 28 has sufficient cross-sectional area to allow the air that is in the bottle to escape without hindering the inflowing water. The side 20 of the bottle, which appears on the bottom in FIG. 2, provides a stable base for filling the bottle which can include multiple gallons.

Figure 3:
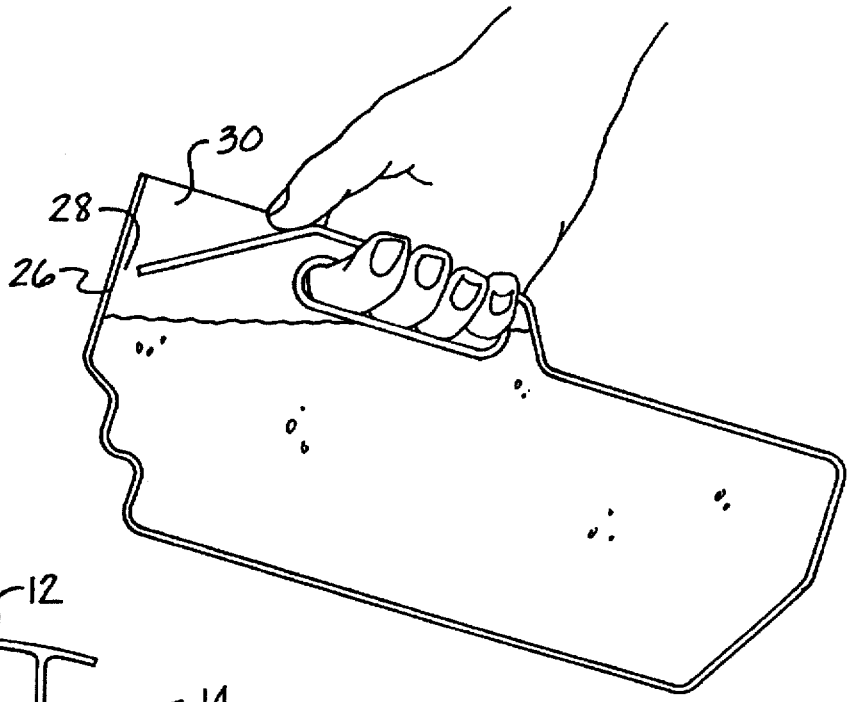
FIG. 3 is a similar sectional view to FIG. 2 with the bottle in the carrying position.

Once the bottle is full, it is lifted by handle 32, as seen in FIG. 3. By reason of the offset nature of handle 32 from the center of gravity, the bottle tends to tip with the fill opening 28 upward so as to minimize the possibilities of spillage.

Figure 4:
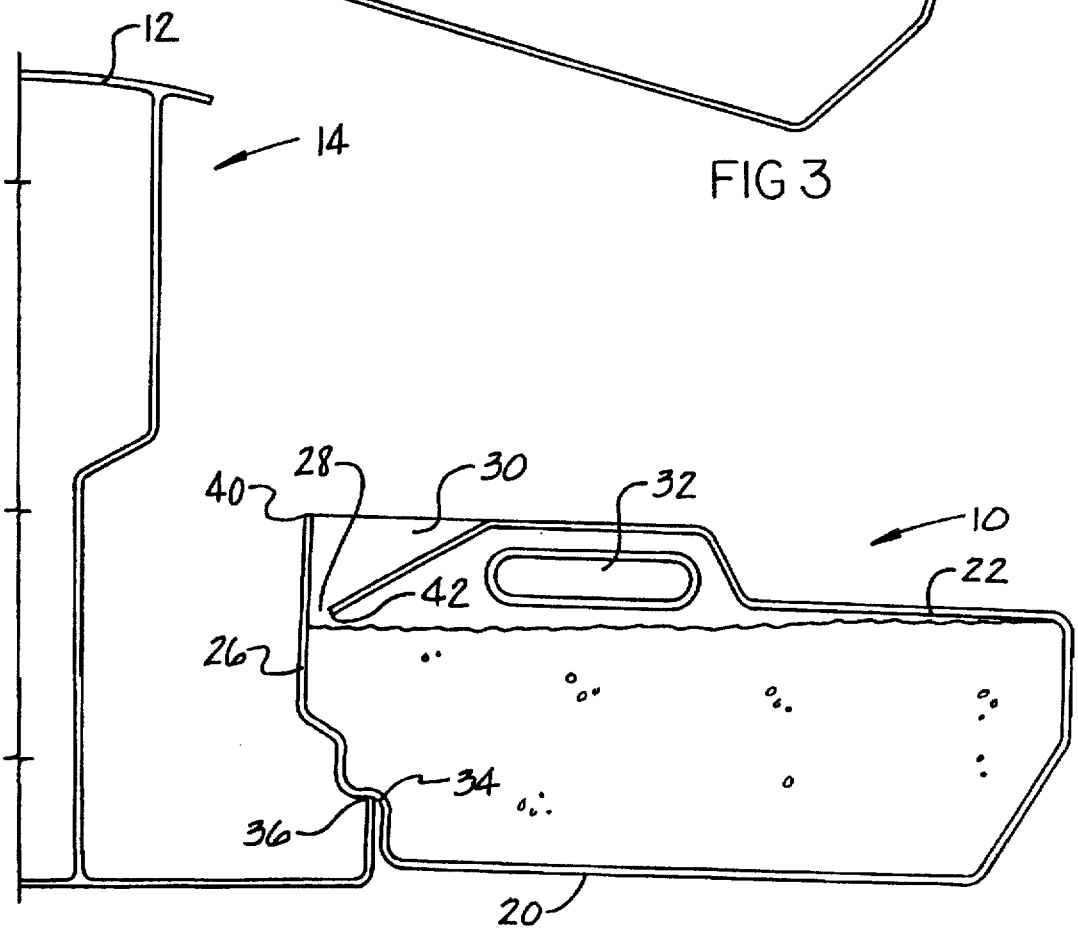
FIG. 4 is a similar sectional view to FIG. 2 with the bottle engaging the edge of the humidifier housing in preparation for rotation to its operative position.
Figure 5:
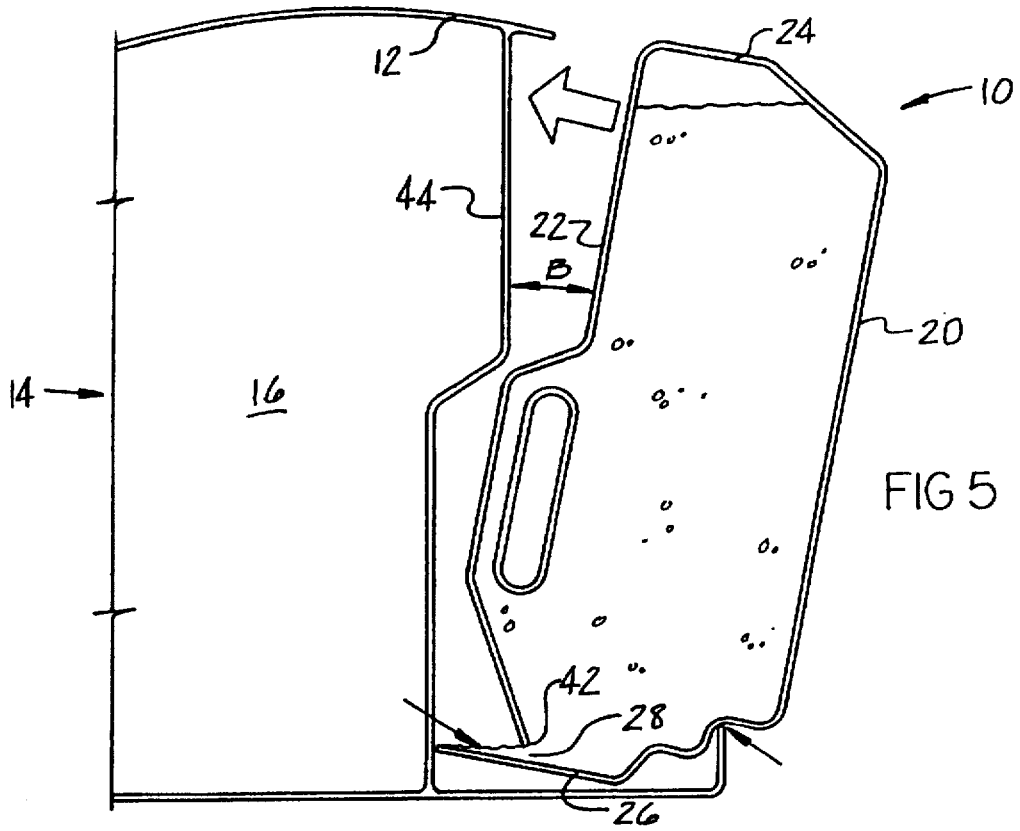
FIG. 5 is a similar sectional view to FIG. 2, with the bottle rotated within 15 degrees of its full vertical operating position.

The bottle 10, still in its horizontal position, is placed on the right edge of the humidifier housing, as illustrated in FIG. 4. The lateral groove 34 along the bottom edge of the bottle is engaged with the outer edge 36 of the humidifier housing which acts as a pivot point for rotating the bottle 10 in a counterclockwise manner, as seen in FIG. 4, to its operative position. As bottle 10 begins its rotation, the forward edge 40 of fill opening 28 remains above the rearward edge 42 until the bottle reaches its FIG. 5 position. This prevents any flow of water from fill opening 28 even though there is a substantial head of water within bottle 10. Once the degree of rotation exceeds the FIG. 5 position and forward edge 40 drops below rearward edge 42, water will begin to flow from the bottle. With the bottle 10 in its operative FIG. 6 position, water will continue to flow out of the bottle until the water level in trough 18 reaches the height A, as illustrated in FIG. 6, whereupon water ceases to flow. As the wicking element of the humidifier, now shown, absorbs the water in trough 18, the fill opening 28 will function as a valve and will retain a water level A at all times during operation of the humidifier until the bottles are exhausted. Since the center of gravity 38, as seen in FIG. 6, of a fill bottle is to the left of the support point 36 of the humidifier, the weight of the bottle will retain the bottle against the vertical wall 44 of the housing of the humidifier. The bottle 10 can be molded of a transparent or translucent material so the water level in the bottle can be monitored during operation. The water in bottle 10 does not begin to flow until the angle B from vertical, as shown in FIG. 5, is less than 15 to 20 degrees. This angle can be adjusted by the altering of the geometry of edges 40 and 42 of fill opening 28.

I claim:

1. A humidifier and a removable water bottle for use in the humidifier, the humidifier having a housing with a water trough therein for receipt of the bottle and a pivot point for support of said bottle:

the bottle including an inner and outer side wall joined by a bottom wall; a fixed opening in the inner side wall approximate the bottom wall, an upper edge means in the fixed opening which valves the water flow closed from the bottle when the water level in the trough exceeds the upper edge; the fixed opening provides a fill opening when the bottle is rotated to a horizontal position with the inner side wall upward; the bottle further includes an engagement point on its bottom wall for engagement with said pivot surface on the humidifier housing for supporting the filled bottle.

2. A humidifier and water bottle, as set forth in claim 1, wherein the fixed opening has a funnel-shape from the fixed opening outward.

3. A humidifier and water bottle, as set forth in claim 1, wherein the bottle includes a handle on the inner side wall for lifting the bottle in its horizontal position.

4. A humidifier and water bottle, as set forth in claim 1, wherein the bottle includes a center of gravity in its filled position and a handle on the inner side wall between the center of gravity of the filled bottle and the fixed opening in the bottle.

5. A humidifier and water bottle, as set forth in claim 1, wherein the fixed opening includes a lower edge which is the bottom of the bottle and is forwardly positioned from said upper edge which is recessed into the bottle.

6. A humidifier and water bottle, as set forth in claim 1, wherein the engagement point on the bottle is a groove in the bottom wall approximate the juncture of the bottom wall with the outer side wall.

7. A humidifier and water bottle, as set forth in claim 1, wherein the inner side wall has an inwardly sloped portion adjacent the upper edge means, forming a funnel around the fixed opening.

* * * * *